United States Patent [19]

Hunt

[11] 4,316,334

[45] Feb. 23, 1982

[54] ATHLETIC SHOE INCLUDING STIFFENING MEANS FOR SUPPORTING THE REAR PORTION OF THE FIRST METATARSAL BONE

[76] Inventor: Helen M. Hunt, Journey's End La., Princeton, N.J. 08540

[21] Appl. No.: 134,651

[22] Filed: Mar. 27, 1980

[51] Int. Cl.[3] ..... A43B 7/22; A43B 13/22; A61F 5/14

[52] U.S. Cl. ..... 36/91; 36/75 R; 128/595

[58] Field of Search ..... 36/91, 129, 32 R, 59 R, 36/59 B, 128, 136, 132, 75, 73, 30 R; 128/617, 621, 595

[56] References Cited

U.S. PATENT DOCUMENTS

| | | | |
|---|---|---|---|
| 2,810,215 | 10/1957 | Clere | 36/75 |
| 3,068,872 | 12/1962 | Brody | 128/595 |
| 3,244,177 | 4/1966 | Scholl | 128/595 |
| 4,050,168 | 9/1977 | Pace | 36/136 |
| 4,130,947 | 12/1978 | Dent | 36/30 R |
| 4,166,328 | 9/1979 | Hamilton | 36/132 |

*Primary Examiner*—Patrick D. Lawson

*Attorney, Agent, or Firm*—Richard C. Woodbridge

[57] ABSTRACT

An improved running shoe includes several means for stabilizing pronation and for promoting and maintaining favorable positioning of the foot while running or jogging. The bottom of the sole has cleats which resist inward rotation of the shoe during certain phases of weight bearing. The sole provides basic support through a wide shank, rigid longitudinal shank reinforcement and relative incompressibility in the medial arch region. The central part of the foot is contained and directly supported by a strong lateral counter and an insert which cooperates with the foregoing elements. A primary purpose of the invention is to provide stable support for the rear half of the first metatarsal bone in a practical and novel manner.

20 Claims, 19 Drawing Figures

ATHLETIC SHOE INCLUDING STIFFENING MEANS FOR SUPPORTING THE REAR PORTION OF THE FIRST METATARSAL BONE

BACKGROUND OF THE INVENTION

1. Field of the Invention

This invention relates to athletic footwear in general and more specifically to stiffening means for stabilizing pronation of the foot by providing support to the rear half of the first metatarsal bone.

2. Description of the Prior Art

The stabilization requirements of feet differ from foot to foot and from activity to activity. Present day shoe design does not adequately cover the range of variability. In consequence, devices such as arch supports and heel cups are expected to do more than should be expected of them insofar as stabilizing the foot is concerned. Flexible devices are often inadequate, while rigid devices are often uncomfortable and therefore intolerable for athletic use.

Most devices employed to stabilize the foot are designed for street shoes. However, problems of foot instability are more apparent and are more frequently encountered in connection with jogging, running and other athletic sports.

During the course of the last few years several devices have been disclosed for improving the stability of athletic shoes. This may be the result of an increased interest in running sports. For example, U.S. Pat. No. 3,992,788 issued to William P. Orien discloses an athletic shoe structure which features padded subtalar support and relatively dense sole construction under the subtalar joint. Edward H. Phillips, in U.S. Pat. No. 4,155,180 discloses a running shoe featuring compressible orthotic support upon a rigid base situated in the rearfoot and shank portions of the sole.

U.S. Pat. No. 3,466,763 issued to Victor Herbert Levin discloses a football shoe of interest including a combined heel counter and lateral counter. U.S. Pat. No. 3,726,287 issued to Simon J. Wikler discloses a construction of medial and lateral abutments adapted to prevent the foot from sliding in the shoe. Of particular interest is the lateral abutment situated by the shaft of the fifth metatarsal bone. U.S. Pat. No. 3,145,486 issued to Constantinos Petalas discloses a shoe having a combined counter support and insole.

U.S. Pat. Nos. 3,997,984 and 4,112,600 issued to George J. Hayward disclose an athletic shoe which provides wide medial arch support and which tends to inhibit pronation by means of a flexible sole which extends fully under the medial arch, curves upwardly in that region and includes a medial heel wedge.

Outer soles for running shoes are known to include a variety of stability aiding features. In U.S. Pat. No. 4,130,947 the inventor, Francis Denu, discloses a sole with deep transverse ribs. U.S. Pat. No. 4,098,011 issued to William J. Bowerman discloses a sole including large medial and lateral cleats on the heel and ball of the shoe. The Osaga Model KT-26 running shoe includes elongated side cleats perpendicular to the perimeter of the sole. Hiking shoes have long been made with this feature. The outer sole of the Adidas "tobacco" Model, a casual shoe, has greater continuity in the medial arch region than elsewhere.

The advantages of different distributions of midsole compressibility are set forth in U.S. Pat. No. 3,103,931 issued to Hans C. Knellwolf and in U.S. Pat. No. 3,738,373 issued to John J. Glancy.

While various prior art shoes disclose some features which assist in stabilizing pronation, none of them appear to disclose the specific features of the present invention which provide support for the rear half of the first metatarsal bone.

SUMMARY OF THE INVENTION

The act of walking or running includes several phases. Pronation is one of the normal phases of gait found in walking or distance running. In these activities, pronation is the means by which the foot absorbs shock. No shoe sole of conventional thickness can absorb all, or nearly all, of the force of a vigorous foot strike. Thus, pronation should not be abnormally restricted because a certain amount of it is healthy and useful. Problems associated with pronation should be treated by the use of footwear which affords stability for the foot structures throughout that phase of gait.

The running shoe of the present invention has a basic structure in which the shank of the shoe is shaped and stiffened so as to provide stable support for the rear portion of the first metatarsal bone. In addition, the upper may be reinforced and an insert provided to further insure stability. In running shoes and in most other athletic shoes the shank is not stiffened. Some running shoes do include a stiff shank. Such shoes tend to be stiff overall even at the ball of the foot. This invention, by contrast, includes specific stiffeners while allowing flexibility where it is otherwise required to achieve an overall stabilizing effect.

Unlike basic orthopedic shoes and most running shoes, the shoe of this invention is constructed to meet changing requirements during gait cycle. In particular, the sole is moderately compressible on the lateral side to provide a gentle landing and stiffer under the medial arch in order to resist inward rotation of the foot and shoe. Also, the shoe is unusually wide under the first metatarsal bone in order to provide improved stabilization when the foot is pronated.

This invention permits even a relatively weak foot to be supported in a stable manner through soft cushioning inside the shoe. Also, by means of a strong lateral counter, it overcomes the common problem of lateral slipping of the foot caused by support for the medial arch.

DETAILED DESCRIPTION OF THE INVENTION

During the course of this description like numbers will be used to identify like elements according to the different drawings which illustrate the invention.

Figure 1C:
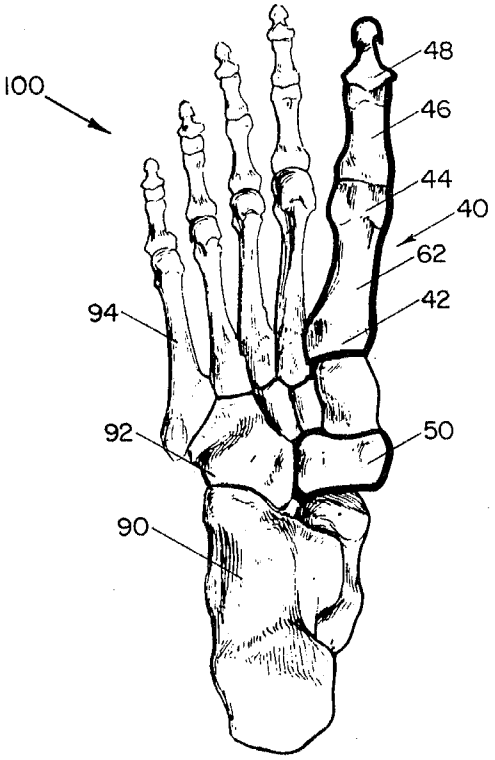
FIG. 1C is a skeletal view of the bones of the right foot as seen from below (plantar projection) in which some of the bones are emphasized for clarity.

The foot bones of concern in this invention are illustrated in detail in FIG. 1C. FIG. 1C is the plantar view of the right foot 100, that is to say, the view of the bone structure that would be seen if the bones could be viewed from below. The bones which are included in the articular structure of the big toe include the distal phalanx 48, the proximal phalanx 46, and the first metatarsal bone 40. The first metatarsal bone 40 includes a posterior base 42, an anterior head 44 and a shank 62. The navicular bone 50 is situated two bones behind the first metatarasal bone 40. It is a primary concern of the present invention to provide stable support to the rear half of the first metatarsal bone 40 including the posterior base 42 thereof, and in many cases to the navicular bone 50. In order to support the first metatarsal bone 40 and the navicular bone 50 in the manner described it may be necessary to additionally provide a lateral counter because of foot slippage. The bones that would be affected by the preferred lateral counter are the cancaneous or heel bone 90, the cuboid bone 92, and the fifth metatarsal bone 94.

Figure 1B:
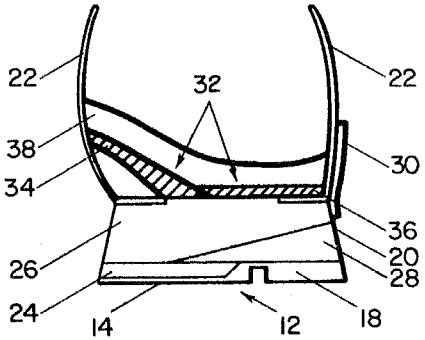
FIG. 1B is a cross-sectional view of the preferred embodiment illustrated in FIG. 1A, together with an insert to provide special support for the navicular bone. The cross-section is at the level of the navicular bone.

The preferred embodiment of the invention is in the context of a running shoe 10. It may be basically understood with reference to FIGS. 1A and 1B. The outer sole 12 includes a large medial arch cleat 14, several transverse first toe cleats 16 and numerous complementary cleats 18. Outer sole 12 is combined with a medial shank stiffener 24 which is also indicated in phantom by the dotted lines 24 of FIG. 2A. The midsole 20 is shaped so that its upper surface extends fully under the first metatarsal bone 40 as shown on the anatomical drawing of FIG. 1C.

Figure 7:
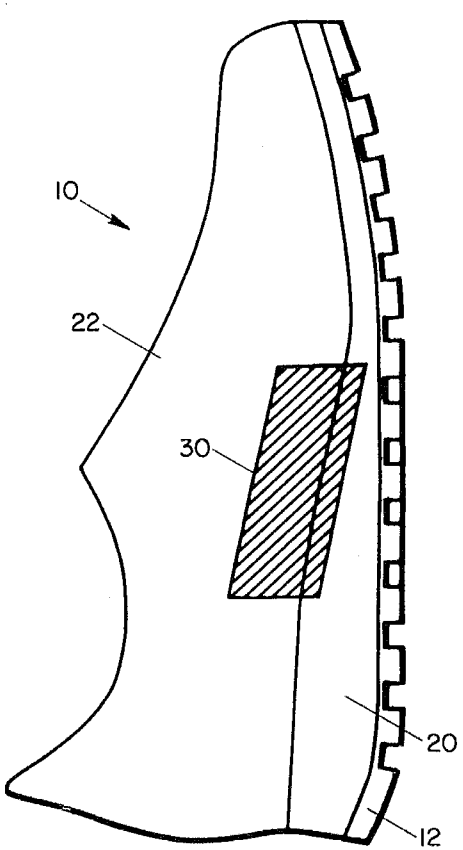
FIG. 7 is a side elevational view of the lateral portion of a shoe showing a lateral counter-shank stiffener included thereon.

The midsole of the midfoot region includes a moderately firm region 26 and a complementary comparatively soft lateral region 28. The shoe upper 22 has heel counter reinforcement 25 and is additionally reinforced by means of a lateral counter 30 such as shown in FIG. 7. Lateral counter 30 also serves to longitudinally stiffen the lateral border of the shoe sole in the shank region thereby giving it substantial additional stiffness against forces perpendicular to the longitudinal axis of the shoe. The foot of the wearer rests on cushioning 38 found inside of shoe 10. An optional insert 32 is recommended if the foot has a collapsed or loosened arch. Option insert 32 includes a rigid base 34 under cushioning 38 for the support of the navicular bone 50 shown in the anatomical diagram of FIG. 1C. A lateral and backward continuation 36 of base 34 serves to anchor insert 32. Other details of the preferred embodiment may be appreciated from the description of the embodiments as illustrated in FIGS. 2A–10B.

Figure 2B:
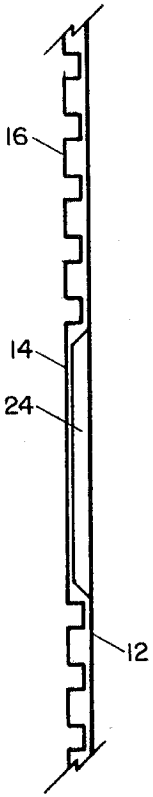
FIG. 2B is a longitudinal cross sectional view of the bottom sole of FIG. 2A showing a stiffening element included in the medial arch cleat.
Figure 2A:
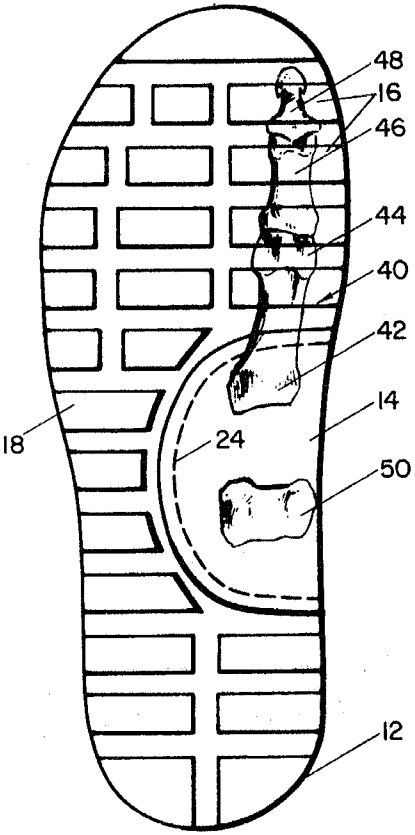
FIG. 2A is a bottom plan view of the shoe of FIGS. 1A and 1B illustrating the relative location of the large medial cleat with respect to the rear half of the first metatarsal bone.

FIG. 2A illustrates the position of the large medial cleat 14 relative to the bones of the foot 100. The large medial arch cleat 14 extends under at least the medial half of the base 42 of the first metatarsal bone 40 and is at least 3 centimeters long in the typical adult shoe and preferably longer. As described previously, the shank stiffener 24 is illustrated with a phantom line and is located within or directly above cleat 14. The drawing of FIG. 2A illustrates a rounded shape which has worked well, but the exact size and shape may be altered somewhat. The cleat 14 should preferably not extend anteriorly, i.e. ahead of, the head 44 of the first metatarsal bone 40, nor should it extend laterally any closer than 2 centimeters from the lateral border of the outer sole 12. However, under some circumstances the cleat 14 might extend posteriorly, i.e. rearwardly, to the back edge of sole 12. If stabilization in the region of the navicular bone 50 is desired, it is recommended that the medial arch cleat 14 extend posteriorly under the navicular bone 50 as shown in FIG. 2A. The transverse first toe cleats 16 extend fully across the articular bone structure of the first toe which includes the distal phalanx 48, the proximal phalanx 46 and the anterior portion of the first metatarsal bone 40. Separate sequential cleats 16 are desirable in that region to provide some longitudinal flexibility there. The number, size and shape of the toe cleats 16 can be altered to fit the requirements of the wearer. In addition the cleats 16 may extend laterally most or even all the way to the lateral border of the sole. Or, they might be slightly curved and angled instead of straight as shown in the drawings. Or the cleats 16 might be 10° or 15° off the transverse axis instead of strictly transverse to the long axis of the foot as shown.

Complementary cleats 18 are distributed over the remainder of the bottom sole 12 in order to give an even ride. Their specific size, location and orientation may be dictated by other shoe requirements.

The large medial arch cleat 14 and the transverse first toe cleats 16 may incorporate on their surfaces a secondary cleat or tread structure in order to improve the grip of the outer sole 12.

The outer soles of most present day running shoes are made of natural or synthetic rubbers. Some are made from plastic materials. Such materials are suitable for use in the outer sole 12 of the preferred embodiment of the invention, although the large medial arch cleat 14 and the transverse first toe cleats 16 are preferably made at least in part of a composition material which is harder, stiffer, and more durable than rubber, and which has better traction properties than conventional rigid plastic. An example of a composition material suitable for this purpose is a mixture of Shoe Patch® and pulverized rubber. Shoe Patch® is the trademark of a product produced by the KiWi Polish Company of Pottstown, Pennsylvania 19464 and is intended primarily for the repair and maintenance of shoe soles. A suggested ratio is, by volume, two (2) parts Shoe Patch® to one (1) part pulverized rubber. Whether or not this specific material would be suitable in large scale production has not been determined. Ideally, the medial arch cleat 14 and the first toe cleats 16 would be molded integrally with the structure of the bottom sole.

Figure 1A:
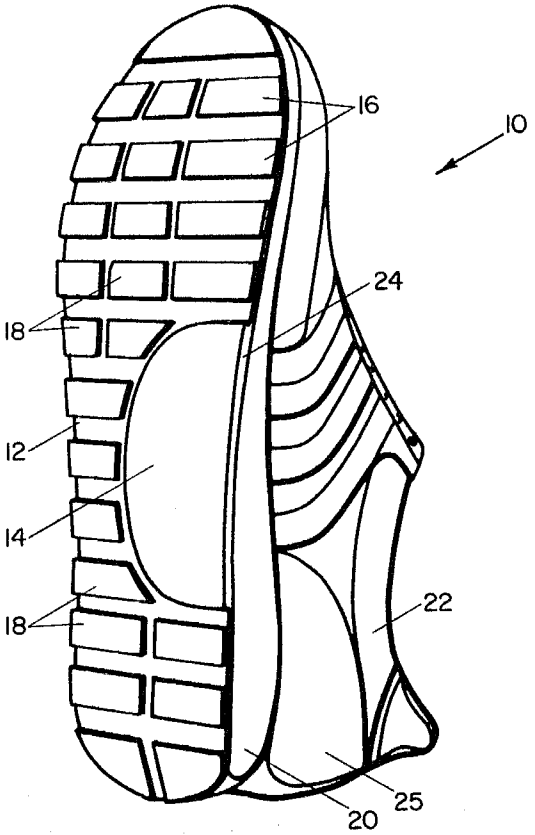
FIG. 1A is a bottom perspective view of an athletic shoe adapted for wear on the right foot according to the preferred embodiment of the invention.

The invention includes a means for providing medial longitudinal stiffening to the shank. This may be achieved simply by constructing most or all of the large medial arch cleat 14 out of a rather stiff material, such as the material described in the previous paragraph. Alternatively, or in addition thereto, a separate stiffener 24, made, for instance, of Nylon® or other rigid plastic, may be included as shown in FIGS. 1A and 2A. Nylon® is a trademark of the E. I. DuPont Company of Wilmington, DE. Such a stiffener 24 preferably has one of the following three forms. Firstly, it could be approximately horizontal and combined with the large medial arch cleat 14 of the outer sole 12 as indicated by element 24 in FIG. 2B and by the dotted line in FIG. 2A. This is the form of the preferred embodiment. Or, secondly, it could be approximately vertical and situated along the lower medial side of the sole. Or, thirdly, it could include regions of both types. In the last two embodiments, the stiffener preferably joins the outer sole 12 and may be molded integrally with the outer sole. The exact nature of the additional stiffening is largely determined by the properties that the sole would have without the extra stiffening. In general a very flexible sole needs a horizontal stiffener. On the other hand, a thick soft sole would need a vertical stiffener along the medial border of the shank.

The large medial arch cleat 14 and the first toe cleats 16, by virtue of their resistance to stretching, impart to the corresponding regions of the sole a predetermined resistance to bending, which depends, of course, upon the construction of the sole itself. In general, the cleat structure increases the transverse stiffness of the medial arch and first toe regions of the sole. Transverse stiffness is greatest if the cleats themselves are constructed of stiff material or, in the shank region, if the medial arch cleat is combined with a horizontal shank stiffener. The effect of medial transverse stiffness depends upon the geometry of the medial border of the sole. When weight is borne on a shoe having the structure of the preferred embodiment, the shoe sole resists inward rotation of the shoe about the medial border. This resistance occurs in the region of the shank or toe where the weight is applied. Since the shank is wide medially, as shown in the drawings, the transversely stiffened shank provides strong resistance to inward rotation about its medial border. In this manner, resistance to pronation is provided by the structure of the lower shoe sole. The construction does not create torque when weight is borne on the lateral side of the shoe. Also, the structure does not provide resistance to either supination or normal forward roll of the foot.

Figure 3:
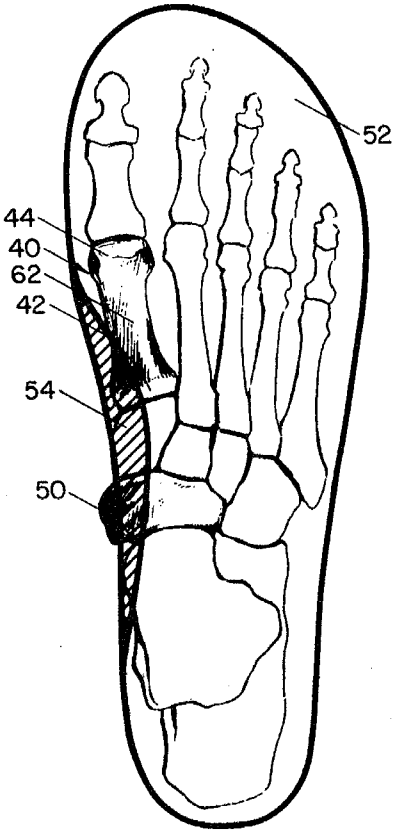
FIG. 3 is a top plan view of the upper surface of the midsole of the shoe of FIGS. 1A and 1B contrasted with that of a conventional running shoe, shown with the bone structure of the right foot superimposed thereon.

A wide shank is recommended also for general support of the foot. Indeed, it is known that support for the anterior half of the first metatarsal bone promotes medial stability. However, in running shoes such support is often inadequate because it is soft and because the posterior half of the bone, not being fully supported or adequately contained, rotates over the soft edge of the midsole when the foot pronates. Thus, support for the posterior half of the first metatarsal bone is essential. Accordingly, fairly wide support for other parts of the medial arch is also preferred. The outer outline of FIG. 3 represents a preferred shape for the upper surface of the midsole 20. The shaded area represents a portion which is typically omitted from the upper part of the midsole in present day running shoes. Some present day running shoes are built on a straight last and have a midsole whose medial arch border lies between the two shown in FIG. 3. FIG. 3 also illustrates that full lateral support, especially for the 3rd, 4th and 5th toes, is recommended.

Figure 4:
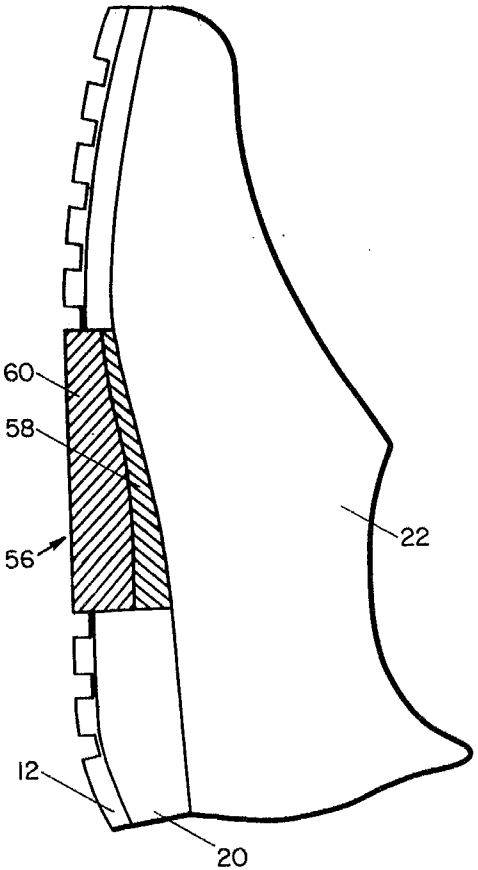
FIG. 4 is a side elevational view of the medial portion of a running shoe which includes an add-on stiffening component to widen and stiffen the medial border of the shank of the shoe.

It is another aspect of the present invention that a shoe which provides medial support and longitudinal stiffening of the shank as already described might be constructed by starting with a suitable conventional running shoe and adding a part to the medial side of the shank of the sole. Such a part, or add-on stiffener 56, is illustrated in FIG. 4. The upper part 58 of the add-on stiffener 56 is made of midsole material and the lower part 60 includes a longitudinal shank stiffener which might comprise a long piece of stiff plastic such as Nylon®. The upper part 58 should be at least 0.3 centimeters wide at the base of the first metatarsal bone, preferably wider. The shank stiffener 56 should extend longitudinally at least from the shaft 62 of the first metatarsal bone 40 to the navicular bone 50. If such a stiffener 56 were made for the typical running shoe sole, its convex side would then be made of midsole material so that it may be readily shaped to fit the concavity of the medial arch region of the sole of the existing shoe. Its bottom edge would preferably be cut to come even with either the bottom of the midsole, 20, or with the bottom of the outer sole 12 as shown in FIG. 4. In the latter case, the bottom of the outer sole 12 might need reinforcement at the juncture. A suitable reinforcing material would be Shoe Patch® as previously described. The upper surface of add-on stiffener 56 is shaped to come even with the upper surface of the existing sole. The add-on stiffener 56 is attached to the sole with suitable cement, such as Barge, a product of Barge Cement Division, Pierce and Stevens Chemical Company, Buffalo, N.Y., or Shoe Patch®, and perhaps with nails cemented in. The procedure would best be preformed by a shoe repairman, although the typical consumer could, with care, do an adequate job. Unfortunately, not all running shoes are adaptable to receive such a part. For example, the Adidas TRX has a midsole which incorporates a circumferential groove in the side and is made of a synthetic foam crepe-like material which cannot be bonded to an add-on stiffener 56 with readily available, conventional cement.

According to the preferred embodiment, midsole construction which is of somewhat lower compressibility in the medial arch region than in other regions promotes medial stability and helps prevent the midsole of the medial arch region from "bottoming out," i.e. permanently squashing down. As suggested in FIG. 1B, this problem can be solved by joining a wedge 26 of moderately firm midsole material to a complementary wedge 28 of comparatively soft midsole material. An alternative solution is to provide holes in the midsole material where greater softness is desired.

Figure 5:
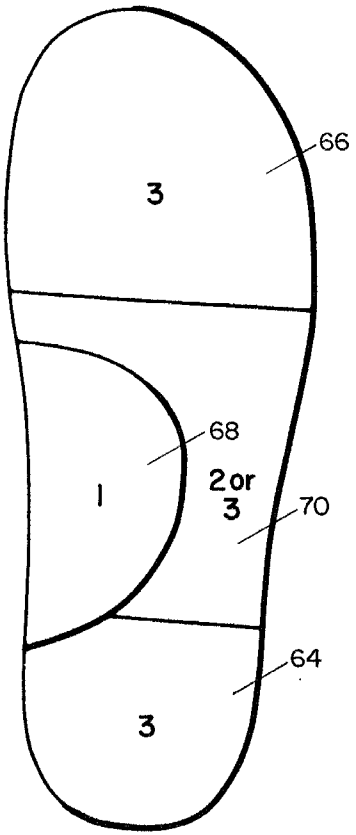
FIG. 5 is a schematic representation of average densities of the midsole of the preferred embodiment of the invention as shown in FIGS. 1A and 1B.

Other variations of midsole compressibility can be beneficial to the athlete. FIG. 5 represents two distributions which are recommended. Compressibility is rated "1" for moderately firm, "3" comparatively soft and "2" for intermediate values. According to the diagram, region 64 is the heel region, region 66 is the toe region, region 68 is approximately the medial arch region and region 70 is the remaining region. The two recommended relative distributions are: region 64—"3", region 66—"3", region 68—"1" and region 70—"3", or region 64—"3", region 66—"3", region 68—"1", and region 70—"2". A third recommended distribution, not illustrated, is like the second of the foregoing distributions except that the region of intermediate density "2" extends forward to include the medial side of the toe region 66. This feature provides control of forefoot pronation and helps prevent "bottoming out" of the midsole under the big toe.

Figure 6B:
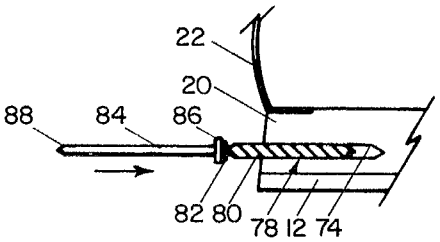
FIG. 6B is a cross sectional view of a cavity such as found in the adjustable midsole of FIG. 6A showing the insertion of a removable stiffener into the cavity by means of a suitable tool.
Figure 6C:
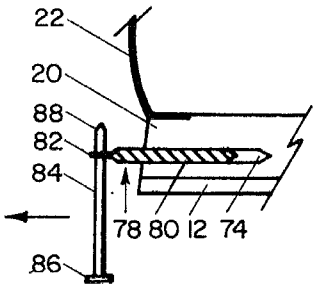
FIG. 6C is a cross sectional view of an adjustable midsole as shown in FIG. 6A which discloses a tool and method for removing a removable stiffener from the cavity.
Figure 6A:
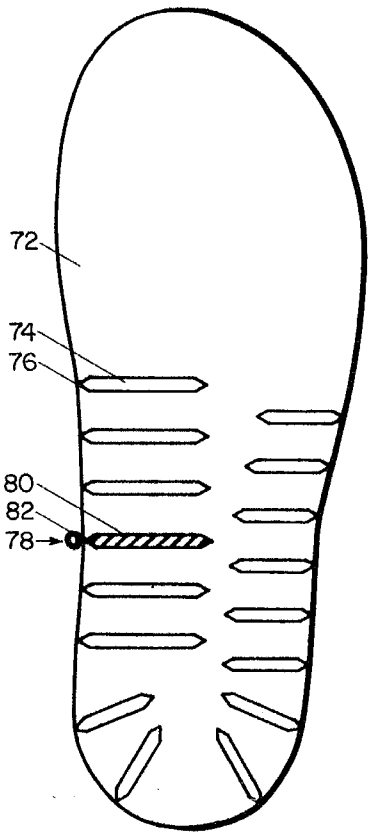
FIG. 6A is a cross sectional view of an adjustable midsole of an alternative embodiment as seen from above, showing cavities for the reception of removable stiffeners and one stiffener in a cavity.

Optimal distribution of midsole compressibility depends upon such factors as the body weight of the runner, his foot structure, his running speed, the terrain, and so on. Thus, for general use, it would be desirable to construct a midsole 20 to have adjustable compressibility. Accordingly, FIG. 6A illustrates an alternative embodiment of the present invention which comprises a resilient midsole 72 including a plurality of cavities 74 adapted to receive one or more removable stiffening elements 78. A typical cavity 74 is cylindrical in cross section but has conical end portions. The cavity 74 communicates with the exterior of the sole through a small opening 76 in the external wall. The stiffener 78 includes a body portion 80 which fits into cavity 74 and a small loop portion 82 connected to one end of body 80. The body 80 is preferably formed of a light-weight plastic and the loop 82 is preferably formed of a strong thin line such as Nylon® fishing line. A conventional tool or applicator 84 is used for inserting and removing the stiffener 78. A suitable tool 84 comprises a common flat headed nail-like object at least 2" long. The tip 88 of tool 84 may be passed through the loop 82 for removal of the stiffener 78. The head 86 of tool 84 may be used to push the stiffeners 78 into cavities 74. Alternatively, a pair of small household pliers or a kitchen fork could be used in place of the preferred embodiment of the tool 84. The tip 88 of tool 84 may be rounded for safety purposes. As shown in FIG. 6B, the stiffener 78 is inserted into the cavity 74 by means of force applied with the head 86 of the preferred tool 84. The small opening 76 of the cavity 74 is easily expanded by the leading pointed end of the stiffener 78. Once the body 80 of the stiffener 78 is entirely inserted, the opening 76 contracts to keep the stiffener 78 from falling out. As shown in FIG. 6C the stiffener 78 may be removed from the cavity 74 by inserting the tip 88 of the tool 84 through the loop 82 and applying outward force to draw the stiffener 78 out in the direction of the arrow illustrated in FIG. 6C. The opening 76 of the cavity 74 is easily expanded by the tapered head of the insert 78 adjacent to the loop 82.

A stiffener 78 may include, in addition to a body 80 and a loop 82, a small stiff extension at right angles to the body, located at the same end as the loop. The function of such an extension would be to prevent the stiffener from becoming lost in a hole which is too deep for it. However, this possibility can be minimized by color coding the cavity 74 and stiffener 78 or by making all cavities 74 of the same depth and internal construction. In any event, a lost stiffener 78 can be retrieved with a small crochet hook or similar item. A small hook might even be provided at the end of tool 84 if desired.

The midsole material which includes the cavities 74 should be rather stiff, both for durability and because the empty cavities 74 increase the compressibility of the midsole. The cavities 74 should be preferably about 3/16" in diameter and should be situated in the rearfoot and/or shank regions, where the midsole is fairly thick. For simplicity, the cavities 74 should all have the same diameter and at most two different lengths. However, the stiffeners 78 might have different degrees of transverse compressibility or of longitudinal stiffness. For example, a hollow stiffener and a solid stiffener might have about the same transverse compressibility, but the hollow one may be made of more rigid material and therefore have less longitudinal flexibility. Hence it is possible to vary the resistance to bending somewhat independently of compressibility.

In the preferred embodiment, medial arch support is provided. However, it is known that the use of a conventional arch support in a sneaker or similar shoe frequently causes the foot to slide laterally and fall off the lateral side of the shoe sole. The problem is reduced with the use of larger, stiffer heel counters such as used in some present day running shoes, but there continue to be many failures.

The preferred embodiment of the invention includes a good heel counter and a lateral counter 30, such as shown in FIG. 7, which is constructed and installed so as to longitudinally stiffen the lateral border of the shoe sole. Counter 30 is preferably made of a plastic material. The plastic material is somewhat flexible when thin, but becomes quite rigid in thicknesses of ½ a centimeter or more. Counter 30 is relatively thin, hence somewhat flexible, but unlike conventional counters it is attached to the sole not horizontally, but vertically, (See FIG. 1B) along a height of at least ½ centimeters, that is to say the counter 30 is attached to the vertical side of the sole rather than to the horizontal top of the sole. By this technique the counter imparts a longitudinal stiffness to the lateral border of the shank region of the sole.

In practice, excellent results have been achieved by attaching a lateral counter to the outside of an existing running shoe. The shoes employed had a suede material secured to the upper of the shoe in the region to be stiffened. A successful method is as follows: Several small applications of Shoe Patch® are spread over the suede and over an upper horizontal strip of the midsole. Generally two pieces of fiberglass cloth are applied separately between applications of Shoe Patch®. Alternatively, a corresponding piece of plastic, or fiberglass reinforced plastic, might be cemented in place to give similar results. The piece might be covered with fabric or leather for the purpose of improving its appearance, although weight is minimized if no covering material is used.

The lateral counter is preferably located adjacent the anterior part of the calcaneous bone 90, the cuboid bone 92 and the posterior part of the fifth metatarsal bone 94. Its height is such that it restricts only the bottom part of the side of the foot.

Figure 10B:
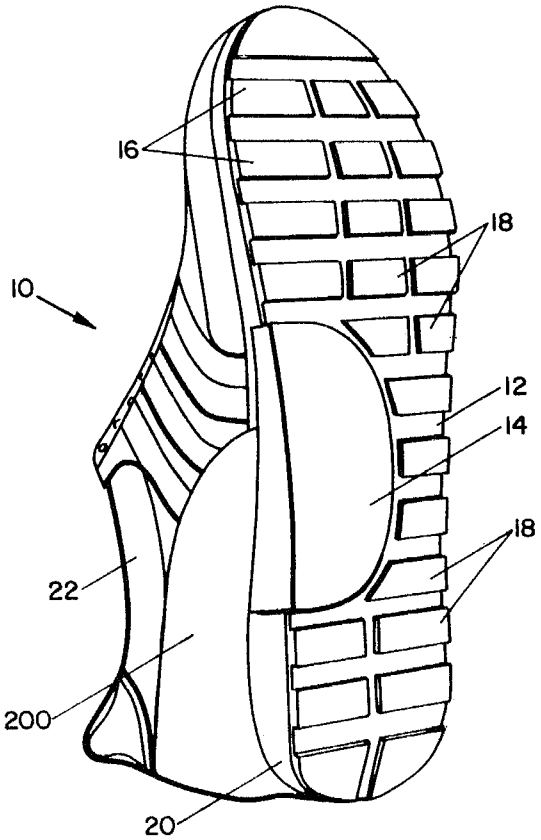
FIGS. 10A and 10B illustrate an embodiment of the invention in which the heel counter is continuous and integral with the lateral counter and medial counter.
Figure 10A:
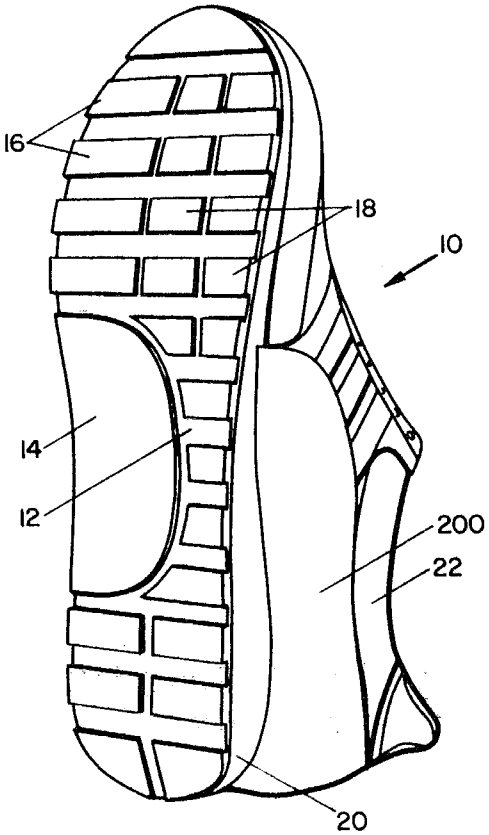

It is another aspect of the present invention to continue the lateral counter backwards around the heel and forward along the navicular bone 50 provided that the shank is fairly wide as illustrated in FIG. 3. This embodiment 200 is illustrated in FIG. 10A and 10B. The height of the counter 200 rises around the back of the heel and declines downwardly toward the shank of the shoe. The height of the counter 200 also depends upon the height of the anticipated shoe insert or inlay, so that it contains but does not irritate the foot. For a foot having a fallen or weakened arch, it is possible to achieve acceptable results, without the use of a rigid insert under the navicular bone, by employing both the extended continuous counter construction 200 of FIGS. 10A and 10B and the lower longitudinal medial stiffening element 56 as attached to the medial side of the shank.

According to the preferred embodiment of the invention the cushioning 38 on which the foot rests may comprise any one or all of the following elements: a flat cushioned insole; a mass produced contoured cushioned insole; a continuous cushioned insole which the wearer fashions himself; or, preferably, a cushioned insert custom made by a capable professional. All of the foregoing are considered "inserts" whether or not they are cemented into the shoe.

Figure 8C:
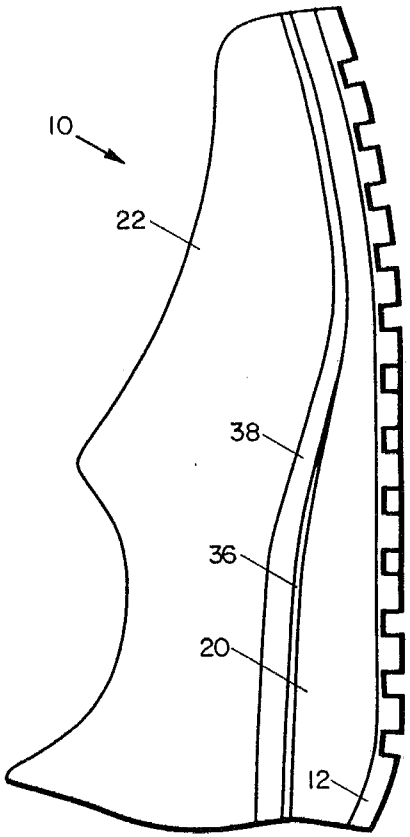
FIG. 8C is a side elevational view of the lateral portion further describing the nature and location of the insert illustrated in FIGS. 1B and 8A.
Figure 8B:
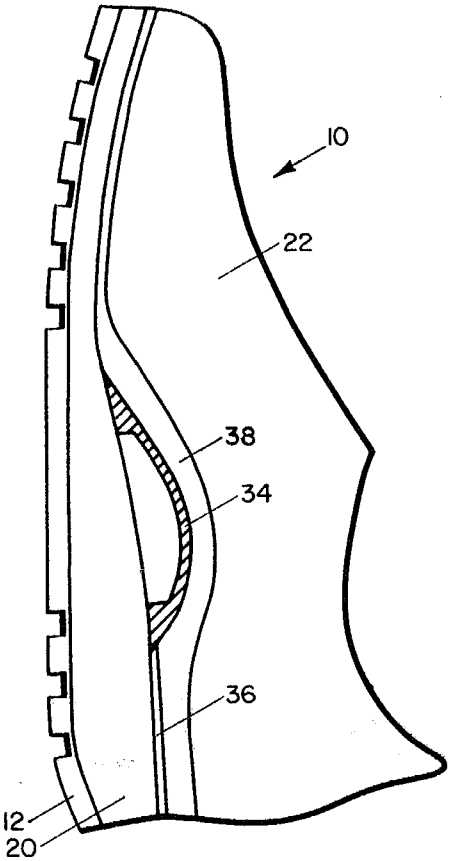
FIG. 8B is a side elevational view of the medial portion illustrating the form and location of the insert illustrated in FIGS. 1B and 8A.
Figure 8A:
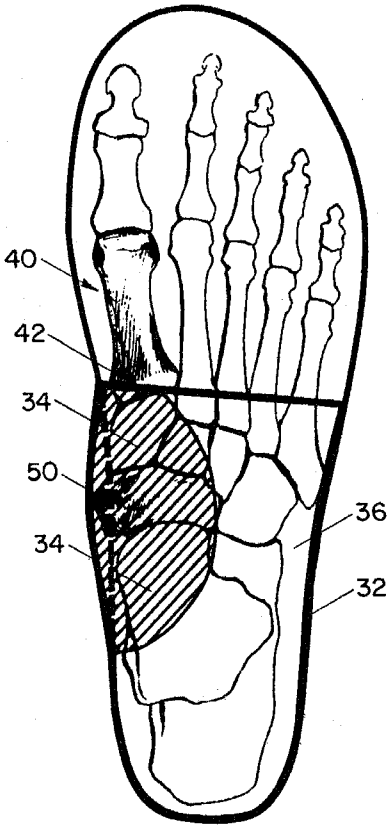
FIG. 8A is a top plan view of the upper surface of the shoe insert of FIG. 1B which is rigidly reinforced in the region of the navicular bone, shown in relation to the bone structure of the right foot and to the supporting surface of the shoe sole.
Figure 9B:
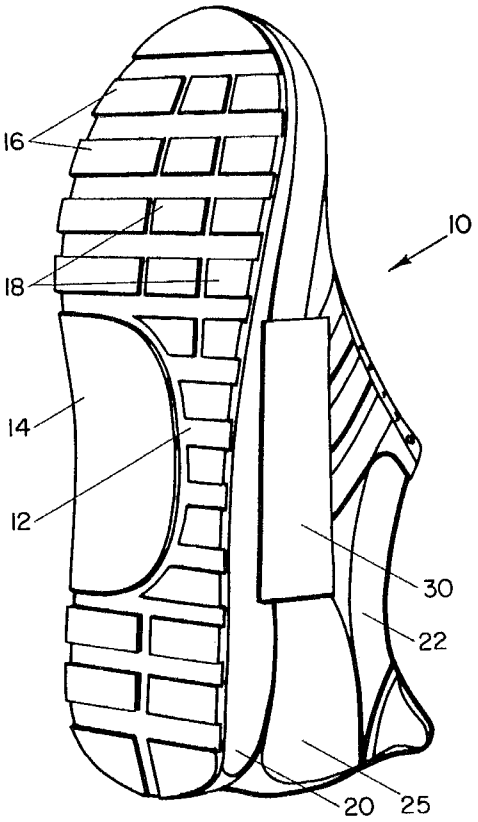
FIGS. 9A and 9B illustrate an embodiment of the invention in which the medial arch cleat and the medial stiffener are continuous and integral as shown in the context of the two different perspective bottom views of a left foot athletic shoe.
Figure 9A:
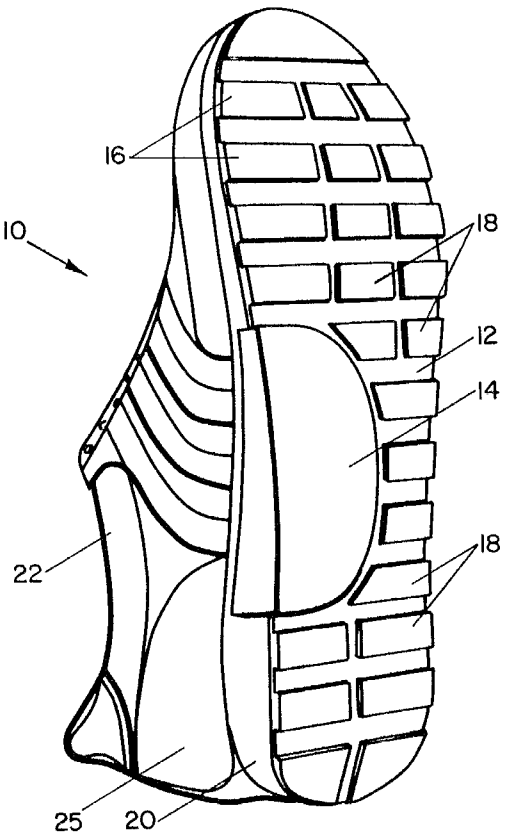

As previously described, if the foot of the wearer has a collapsed or loosened arch, it is the recommendation of this invention to provide a rigid support base 34 for the navicular bone 50 as described in FIGS. 1B, 8A–8C. According to the preferred embodiment, such a structure 34 is part of an insert 32 as shown in FIGS. 1B and 8A–8C where element 36 is a lateral and backward continuation of element 34. Since the insert 34 is fairly wide the shoe must also be wide to accomodate the insert 34. The insert 32 is similar in some respects to so-called plastic orthotics, but differs in at least the following three major respects. First, it is intended for use with a soft orthotic covering. Secondly, it may be mass produced, because exact support is accomplished by precise construction of the soft orthotic covering. Thirdly, no rigid part of insert 32 extends anteriorly to the posterior half of the first metatarsal bone 40. See FIG. 8A. This third difference is fundamental and reflects a very important structural aspect of the shoe. The sole is wide at the base of the first metatarsal bone 40 and will thus support the anterior portion of the wide rigid region 34 of insert 32. FIG. 8B suggests that region 34 might be reinforced at its two ends like a bridge. If desired, insert 32 might be cemented into the shoe or its bottom surface could be provided with a plurality of spikes to anchor it in the shoe bed.

Insert 32 could be sold separately from the shoe since a majority of wearers would not need it. As mentioned, it may be mass produced, but it might also be made individually or in small numbers for podiatrists or other qualified professionals. It is recommended that the cushioned support 38 above insert 32, i.e. the soft orthotic covering, be custom made by a capable professional. A professional may wish to combine the two structures into a single insert.

The use of an insert in the foot receiving cavity of a shoe imposes certain new conditions upon the shoe upper 22. Specifically, the upper and the counters need to be a little higher than if no insert were used. That is because the insert raises the foot. However, care should be taken that no stiff counter is so high as to cause irritation during athletic activity.

As we have seen, according to this invention the foot is in all cases directy supported by a good layer of cushioning, and no rigid portion of the structure will interfere with the normal flexing of the foot at the ball. In particular, activities such as sprinting and jumping can be comfortably pursued.

As described in great detail above, the primary purpose of the invention is to provide stable cushioned support to the posterior half of the first metatarsal bone 40 including the base 42. Accordingly, the specific preferred embodiment is as shown in FIG. 1A wherein a large medial arch cleat 14 includes above it a shank stiffener 24 which provides support to the critical area. The arch cleat construction 14 may be employed with or without an additional medial stiffener 56. Under some circumstances the medial stiffener 56 may be added on separately (See FIG. 4) or could be incorporated into the structure of the sole 12 itself (See FIGS. 9A and 9B). The support for the rear half of the first metatarsal bone 40 and other parts of the medial arch may cause the foot to slide outwardly and therefore a lateral counter-shank stiffener 30 may be employed. Finally, an insert 32, such as illustrated in FIG. 1B and 8A–8C, might also be employed to enhance the effect of the invention. Therefore, while FIGS. 1A and 1B describe the preferred embodiment it will be understood by those who have studied this disclosure that under some circumstances the lateral counter-shank stiffener 30 and the insert 32 can be used independently of the medial stiffener means. The alternative embodiment of FIGS. 6A–6C could be used without any of the other features.

As previously described the stiffener 56 can be of the add-on variety as illustrated in FIG. 4. Alternatively, the stiffener 56 may be made integral and continuous with the cleat 14 as shown in the perspective views of FIGS. 9A and 9B.

While the invention has been described with reference to a preferred embodiment thereof it will be appreciated by those of ordinary skill in the art that changes may be made to the structure and function of the elements without departing from the spirit and scope of the invention.

I claim:

1. An athletic shoe including an upper and a sole connected to said upper, said shoe further comprising:

stiffener means for providing support to the medial portion of the base of the first metatarsal bone, said stiffening means comprising a continuous cleat attached to the bottom portion of said sole and extending from at least the base of said first metatarsal bone for at least 3 centimeters in the direction of the navicular bone.

2. The shoe of claim 1 wherein said cleat extends no further anteriorly than the head of the first metatarsal bone and does not extend laterally to less than 2 centimeters from the outside edge of said sole.

3. The shoe of claim 1 wherein said stiffener means further comprises:

a vertical medial stiffening element attached to the medial outward side of said sole.

4. The shoe of claim 3 wherein said cleat and said medial stiffening element are integral.

5. An athletic shoe including an upper and a sole connected to said upper, said shoe further comprising:

stiffener means for providing support to the medial portion of the base of the first metatarsal bone, said stiffener means comprising a vertical stiffening element located on the medial exterior of said sole.

6. The shoe of claim 5 wherein said stiffening element is a separate distinct element which is attachable to the medial side of said sole by a bonding agent.

7. An athletic shoe including an upper and a sole connected to said upper, said shoe further comprising:

stiffener means for providing support to the medial portion of the base of the first metatarsal bone, said stiffener means comprising a substantially vertical stiffening element located on the medial exterior of said sole.

8. An athletic shoe including an upper and a sole connected to said upper, said shoe further comprising:

stiffener means for providing support to the medial portion of the base of the first metatarsal bone, said stiffener means comprising a continuous cleat attached to the bottom portion of said sole and extending from at least the base of said first metatarsal bone for at least 3 centimeters in the direction of the navicular bone, said stiffener means further comprising a substantially vertical medial stiffening element attached to the medial exterior of said sole.

9. An athletic shoe including an upper and a sole connected to said upper, said shoe further comprising:

stiffener means for providing support to the medial portion of the base of the first metatarsal bone, said stiffener means further comprising a continuous cleat attached to the bottom portion of said sole and extending from at least the base of said first metatarsal bone for at least 3 centimeters in the direction of the navicular bone, said stiffener means further including a substantially vertical medial stiffening element attached to the medial exterior of said sole, wherein said cleat and said medial stiffening element are integral.

10. An athletic shoe including an upper and a sole connected to said upper, said shoe further comprising:

stiffener means for providing support to the medial portion of the base of the first metatarsal bone; and, a lateral counter means to compensate for the tendency of a foot in said shoe to slide outwardly, said lateral counter means extending vertically from said sole to said upper and attached rigidly to the vertical side of said sole so as to provide substantial stiffness in the longitudinal direction.

11. The shoe of claim 10 further including:

a heel counter extending from said sole to said upper and attached rigidly to said sole.

12. The shoe of claim 11 wherein said lateral counter means and said heel counter are continuous.

13. The shoe of claim 12 further including a medial counter means which extends vertically from said sole to said upper and is rigidly attached to said sole.

14. The shoe of claim 13 wherein said medial counter means, said lateral counter means and said heel counter are continuous structures.

15. A shoe including an upper and a resilient sole connected to said upper, said shoe comprising:

aperture means located in said sole and extending from the exterior edge of said sole towards the interior of said sole, said aperture means comprising a plurality of individual apertures; and, insert means for insertion into said aperture means for stiffening said sole, said insert means comprising a plurality of inserts receivable respectively in said plurality of apertures, said inserts comprising:

a body portion which is receivable in at least one of said apertures; and, a head means attached to said body portion, said head means extending outside of an aperture when said insert is lodged in said aperture, wherein said head means may be readily grasped so that said insert can be selectively removed.

16. The shoe of claim 15 wherein said head means comprises a loop which may be engaged by a tool so that said insert can be readily removed.

17. A shoe including an upper and a resilient sole connected to said upper, said shoe comprising:

cavity means located in said sole and extending from the exterior edge of the sole towards the interior of said sole, said cavity means comprising a plurality of individual cavities; and, insert means for insertion into said cavity means for stiffening said sole, said insert means comprising a plurality of inserts receivable respectively in said plurality of cavities, said inserts including a body portion which is receivable in at least one of said apertures and substantially completely surroundable thereby.

18. An add-on stiffening apparatus for use on a shoe including an upper and a sole connected to said upper, said apparatus comprising:

a relatively rigid elongated element attachable to said sole on the medial side thereof with a long axis of said element running substantially parallel to the long axis of said sole, said element extending at least from the shaft of the first metatarsal bone to the navicular bone, said element being at least 0.3 centimeters wide at the base of the first metatarsal bone; and, bonding means for attaching said element to said sole.

19. The apparatus of claim 18 wherein said element includes an upper and a lower region.

20. The apparatus of claim 19 wherein said upper region comprises a resilient material and said lower region comprises a stiff plastic material.

* * * * *